United States Patent [19]

Matson

[11] 4,436,595

[45] Mar. 13, 1984

[54] ELECTROPLATING BATH AND METHOD

[75] Inventor: Walter T. Matson, Los Angeles, Calif.

[73] Assignee: Metal Surfaces, Inc., Bell Gardens, Calif.

[21] Appl. No.: 358,862

[22] Filed: Mar. 17, 1982

Related U.S. Application Data

[63] Continuation-in-part of Ser. No. 270,844, Jun. 5, 1981.

[51] Int. Cl.[3] ..... C25D 3/62; C25D 5/10

[52] U.S. Cl. ..... 204/40; 204/43 G; 204/46 G

[58] Field of Search ..... 204/43 G, 43 T, 46 G, 204/123, 45 R, DIG. 2, 40

[56] References Cited

U.S. PATENT DOCUMENTS

| | | | |
|---|---|---|---|
| 2,724,687 | 11/1955 | Spreter et al. | 204/43 G |
| 3,149,058 | 9/1964 | Parker et al. | 204/46 G |
| 3,530,049 | 9/1970 | Scherzer et al. | 204/43 G |
| 3,666,640 | 5/1972 | Smith | 204/46 G X |
| 3,708,405 | 1/1973 | Kamata | 204/40 X |
| 3,783,111 | 1/1974 | Bick et al. | 204/46 G |
| 3,902,977 | 9/1975 | Greenspan | 204/46 G X |
| 4,075,065 | 2/1978 | Korbelak et al. | 204/43 G |
| 4,076,598 | 2/1978 | Lerner et al. | 204/43 G |

FOREIGN PATENT DOCUMENTS

| | | | |
|---|---|---|---|
| 9059737 | 10/1974 | Japan | 204/40 |
| 2039532 | 8/1980 | United Kingdom | 204/43 G |

*Primary Examiner*—G. L. Kaplan
*Assistant Examiner*—Nam X. Nguyen
*Attorney, Agent, or Firm*—Christie, Parker & Hale

[57] ABSTRACT

There is provided an improved gold alloy electroplating bath comprising glycolic acid, an alkali metal salt of glycolic acid, gold and an alloying metal plus a chelating agent capable of forming a stable complex with metal impurities, particularly nickel. The chelating agent, the complexes formed and the decomposition products of the chelating agent are substantially innocuous to the functioning of the bath and to the quality of a deposit from the bath. Nitrilotriacetic acid is the preferred chelating agent.

29 Claims, 1 Drawing Figure

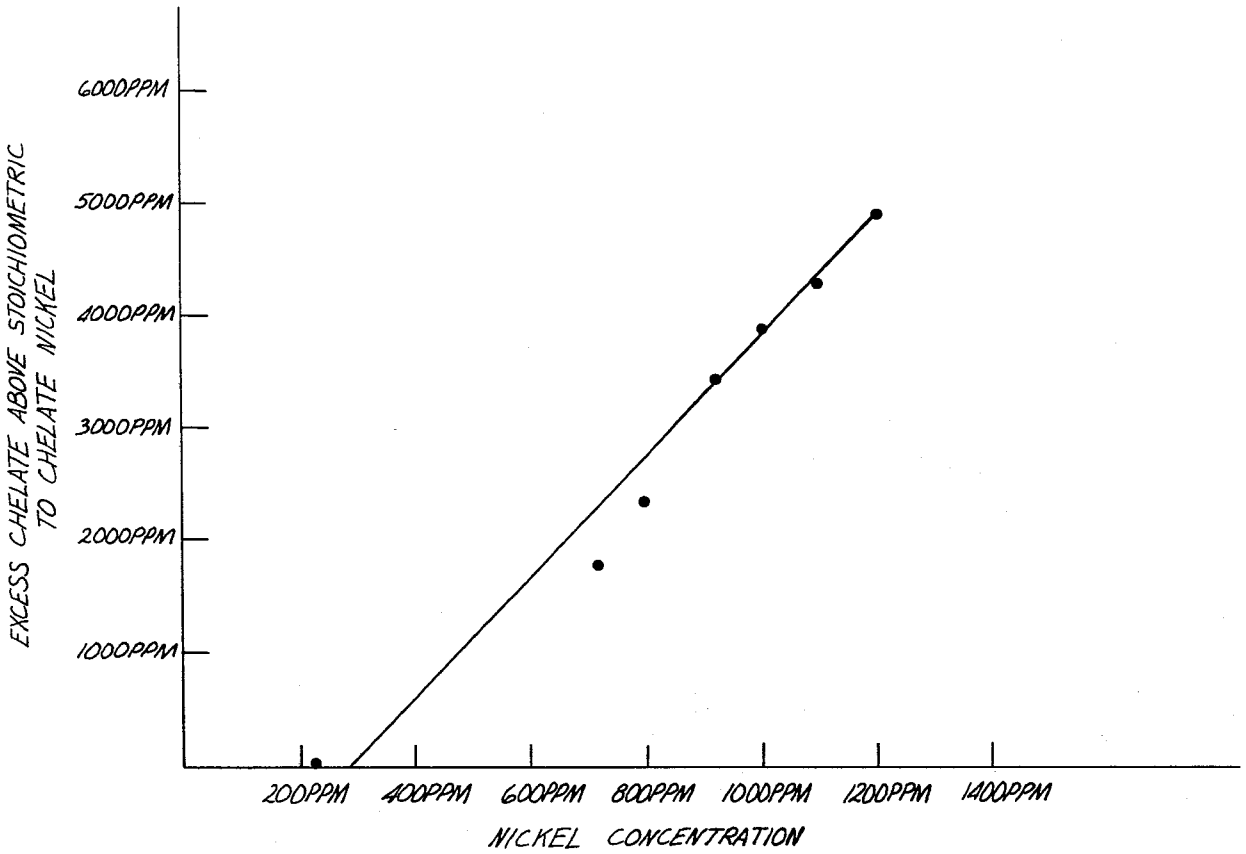
EXCESS CHELATE ABOVE STOICHIOMETRIC
TO CHELATE NICKEL
6000PPM
5000PPM
4000PPM
3000PPM
2000PPM
1000PPM
200PPM
400PPM
600PPM
800PPM
1000PPM
1200PPM
1400PPM
NICKEL CONCENTRATION

ELECTROPLATING BATH AND METHOD

CROSS REFERENCES TO RELATED APPLICATIONS

This application is a continuation-in-part of application Ser. No. 06/270,844 filed June 5, 1981.

BACKGROUND OF THE INVENTION

The present invention relates to improvements in the plating of a gold alloy on metallic surfaces and more particularly to a gold alloy electroplating bath having improved tolerance to metal impurities.

In my co-pending U.S. application Ser. No. 06/270,844, incorporated herein by reference, there is disclosed and claimed a gold alloy electroplating bath and a method for the deposition of a gold alloy layer on a metallic surface from such bath.

The gold alloy electroplating bath comprises an aqueous solution containing a salt of an alloying metal selected from the group consisting of nickel, cobalt and mixtures thereof, the reaction product of an alkali metal-gold cyanide and a mixture of glycolic acid and at least one alkali metal salt of glycolic acid, preferably sodium or potassium. The pH of the bath is maintained at from about 4 to about 5, and preferably from about 4 to about 4.5 by adjusting the ratio of glycolic acid and the alkali metal salt of glycolic acid.

The incorporation of the mixture of glycolic acid and an alkali metal salt of glycolic acid in the gold alloy bath markedly increased the plating rate of the bath.

SUMMARY OF THE INVENTION

It has been found that the level of metallic impurities, particularly nickel, that can be tolerated in the gold electroplating bath before a detrimental amount of the impurity metal co-deposits with the gold can be increased with no detrimental effect by the incorporation in the bath of a chelating agent capable of forming a stable complex with the metal impurity in which the chelating agent, the complex and decomposition products of the chelating agent are all innocuous to both the functioning of the bath and the quality of a deposit from the bath.

More particularly, there is provided a gold alloy electroplating bath comprising the reaction product of an alkali metal gold cyanide, preferably sodium or potassium gold cyanide and an alkali metal salt of glycolic acid in a concentration sufficient to provide a gold content of about 1 troy ounce per gallon of bath. The bath further comprises a salt of an alloying metal selected from the group of nickel, cobalt and mixtures thereof. Preferred salts include hydrated nickel sulfate and hydrated cobalt sulfate.

The bath further comprises a mixture of glycolic acid and an alkali metal salt of glycolic acid in a ratio sufficient to generate a pH of from about 4 to about 5 in the bath. Preferred alkali metal salts of glycolic acid are the sodium and potassium salts.

The bath further comprises a chelating agent capable of forming a stable complex with the metal impurity. The chelating agent, as well as the complexes, formed with the metal impurities and decomposition products of the chelating agent are substantially innocuous to both the function of the bath and the quality of the deposit from the bath. The presently preferred chelating agent is nitrolotriacetic acid, which is preferably added as a salt. Preferred salts include potassium and sodium salts of nitrilotriacetic acid.

The concentrations of gold and alloying metal in the bath are adjusted to provide a deposit of a hard gold alloy.

There is further provided a process for reducing or eliminating the amount of metal impurities in the gold plating bath by the addition to the bath of at least one chelating agent capable of forming a stable complex with the metal impurity and having no detrimental effect on the functioning of the bath or the quality of the deposit. The chelating agent, the complexes formed between the chelating agent and the metal impurities and the decomposition products of the chelating agent are all innocuous to the functioning of the bath and the quality of the deposit. The chelating agent is added in an amount sufficient to chelate substantially all of the metal impurities.

BRIEF DESCRIPTION OF THE DRAWING

The drawing is a graph showing the relationship between the excess amount of ionic nickel impurity and the amount of chelating agent required to tie up the nickel.

DETAILED DESCRIPTION

According to the present invention, there is provided a gold alloy electroplating bath capable of tolerating large amounts of soluble metal impurities without co-depositing a significant amount of metal impurities with the gold in the deposit. There is further provided a method for reducing the amount of metal impurity in the gold alloy bath.

As used herein, "metal impurity" refers to soluble metal ions present in the gold alloy electroplating bath that are detrimental to either the functioning of the bath or the quality of the gold deposited from the bath and include the ions of copper (including cuprous and cupric ions), nickel, cobalt, zinc and the like. If a certain concentration of the metal ions is contained in the bath by design, i.e, to co-deposit with gold to form a select alloy, then the amount of the metal ions in excess of the desired concentration is considered an impurity and that amount is herein included in the definition of "metal impurity.".

The alloy gold electroplating bath comprises a salt of an alloying metal. The salt is selected from the group consisting of nickel salts, cobalt salts and mixtures thereof. Presently preferred salts include nickel sulfate hexahydrate and cobalt sulfate hexahydrate. The gold and alloying metal are present in solution in proportion to provide an electroplate of a hard gold alloy. This generally requires a concentration of from about 0.5 to about 1.0 grams per liter of the alloying metal which results in an alloy deposit containing about 0.3% to about 0.6% by weight alloying metal in the deposit.

The bath further comprises the reaction product of an alkali metal gold cyanide and a mixture of glycolic acid and an alkali metal salt of glycolic acid. The alkali metal gold cyanide is preferably potassium gold cyanide or sodium gold cyanide in a concentration sufficient to provide a gold concentration of about 0.5 to about 5, and preferably one troy ounce of gold per gallon of solution.

The concentrations and ratio of glycolic acid and an alkali metal salt of glycolic acid in the mixture sufficient to fully react with the alkali metal gold cyanide and to provide a bath pH of between about 4 and about 5 and preferably between 4.0 and 4.5 and more preferably 4.2 and 4.35.

The mixture of glycolic acid and an alkali metal salt of glycolic acid is prepared by mixing glycolic acid and an alkali metal hydroxide in an amount sufficient to generate the desired ratio of glycolic acid and alkali metal salt of glycolic acid.

In operation of a conventional electroplating system, the negative terminal of a direct current voltage source is connected to a conductive surface to be plated in the bath which serves as a cathode, and the positive terminal of the voltage source is preferably connected to a platinized titanium anode. The bath is agitated during operation by well-known means. Generally, a layer of gold alloy of about 30 to 100 millionth of an inch in thickness is deposited on the receptive substrate. To achieve this, the immersion of the substrate will range from about 15 to about 30 seconds, depending upon the plating rate and the desired thickness of the plated layer. Current densities of up to 600 amperes per square foot of a receptive substrate can be employed without adverse effects, depending upon the degree of agitation and the other operating conditions. The electroplating solution can be operated at any temperature between freezing and boiling. The lower the temperature, the brighter the deposit, but the slower the plating speed, and vice versa. As a compromise between brightness and plating speed, an operating temperature of 130° F. is preferred.

The chelating agents used in the instant invention are capable of chelating the metal impurity, i.e., forming a stable complex with the metal impurity and are used in a concentration to either effectively eliminate the metal ion as a depositable ion or maintain the free metal ion in a desired proportion to gold with the balance treated as an impurity to be complexed. The bound metal ions are, therefore, innocuous to both the functioning of the bath and the quality of the deposit.

It is also required decomposition products of the chelating agent must also be innocuous to both the functioning of the bath and the quality of the deposit. As used herein, "decomposition product" refers to the compounds or elements formed when a chelating agent breaks down into simplier compounds. This may occur, for example, as a result of a chemical reaction within the body of the electroplating bath or at either the anode or cathode surfaces as current is passed during electroplating. A requirement of the chelating agent is that decomposition does not result in rapid build up and, therefore, frequent treatment of the bath with activated carbon. Activated carbon treatment removes organics but also removes gold which is expensive to recover and represents at least a temporary loss of a very expensive metal.

The stable complex that is formed between the chelating agent and the metal impurity requires a higher electrochemical potential for the reduction of the metal ion to the metal than the free ionic metal impurity. This prevents the complexed metal impurity from being reduced to the metal and co-depositing with gold at the electrochemical potential that is used for gold deposition.

The concentration of the chelating agent depends on the amount of metal impurities expected to be dragged into the gold electroplating bath. Typically, the concentration will be at least sufficient to chelate substantially all of the metal impurities expected in a steady state operation. This prevents signification co-deposition of metal impurities with the gold. An excess is preferred.

By "steady state," what is meant is the dynamic condition that is arrived at after the bath has been in use for a period of time in which the concentration of metal impurities caused by drag-in and drag-out remains substantially constant.

The metal impurity and the chelating agent react to form a complex. The reaction is in dynamic equilibrium wherein there exists the complex and both free chelating agent and free ionic metal impurity. The concentration of the free, i.e., non-complexed, ionic metal impurity and chelating agent depend on the equilibrium constant of the reaction and the total chelating agent metal impurity concentrations. The concentration of chelating agent in the electroplating bath is sufficient to complex substantially all of metal impurity, i.e., to provide a concentration level of free ionic metal impurity sufficient low to not co-deposit with the gold in any significant amount.

In a gold-alloy bath in which nickel is the alloying metal, the chelating agent is added in an amount which chelates at least a portion of the desired free alloying nickel. A nickel addition is then required in an amount sufficient to bring the nickel concentration back to the desired level. This provides a solution with free nickel to co-deposit with gold and free chelating agent to tie up additional metal impurities dragged over from previous plating solutions.

The most common metal impurity in gold electroplating baths is nickel. This due to drag-in nickel ions from a nickel electroplating bath positioned prior to the gold electroplating bath in the plating sequence. Nickel is used as an undercoat to gold for many reasons. If a bright gold deposit is desired, the substrate on which the gold is deposited must be bright. This is because gold has poor leveling characteristics when plated as an extremely thin layer. As a result, the appearance of the substrate will be manifested in the gold deposit. Nickel baths are available with both excellent leveling characteristics and brightness to offset the gold.

An undercoat of nickel may be required as a diffusion barrier and for corrosion resistance purposes. While gold has excellent corrosion resistance, the gold deposit is generally too thin to act as much of a corrosion inhibitor. Therefore, a barrier of nickel between the gold and the substrate, for example zinc diecast or brass, may be required. An undercoat of nickel may also impart desirable hardness to the overall deposit.

The concentration of nitrilotriacetic acid in a gold electroplating bath depositing substantially pure gold may vary but is preferred to be at least sufficient to chelate substantially all of the metal ion expected to be present in the bath when a steady state concentration has been reached.

There is further provided a method for reducing the concentration of metal impurities in such a gold alloy electroplating bath. The method comprises adding chelating agent capable of forming a stable complex with the metal impurity in an amount sufficient to form said complex. The chelating agent, the complexes formed between the chelating agent and the metal impurities, and the decomposition products of the chelating agents are all innocuous to the functioning of the bath and the quality of the deposit.

For alloy systems, the amount of chelating agent added to a gold alloy electroplating bath depends on the metal that is alloyed with the gold. If the metal that is alloyed with gold does not form a stable complex with the chelating agent, the chelating agent may be added in excess of the impurity metal concentration. However, if the metal that is alloyed with the gold also forms a stable complex with the chelating agent, the amount of chelating agent that is added to the bath is at least sufficient to reduce the concentration of the metal impurity to an acceptable level. The amount of the co-depositing metal that complexes with the chelating agent is replenished by an appropriate addition of that metal.

The preferred chelating agent is nitrilotriacetic acid preferably introduced as a salt. The sodium salt of nitrilotriacetic acid, the potassium salt of nitrilotriacetic acid and mixtures thereof may be used. The potassium salt is presently preferred. In a preferred embodiment, the chelating agent is added in a chelating solution which is prepared by mixing an aqueous solution of nitrilotriacetic acid with potassium hydroxide in an approximately 1:1 weight ratio of about 135 g/l. The preferred pH of the chelating solution is from about 4 to about 6.

The decomposition products of nitrilotriacetic acid are nitrogen gas and carbon dioxide which are also substantially innocuous to the bath and deposit.

This invention has a striking advantage that the level of metallic impurities co-deposited with the gold alloy from a gold alloy plating bath may be reduced significantly with no loss of functionality to the bath or quality to the deposit. Therefore, because the decomposition products are innocuous, there is no need for periodic carbon treatments which are used in conventional plating processes to eliminate organic contamination and which result in a substantial loss of gold.

In the application of this invention, the systems to primarily control are gold alloy systems. Where the bath is a nickel-gold bath, the function of the chelating agent is to tie up excess nickel which is dragged into the gold plating bath. Where the bath is a gold-cobalt bath, the function is to tie up all of the nickel. In this instance, cobalt may also be complexed in a competing complexing reaction requiring addition of make up cobalt.

A presently preferred gold alloy bath of a given volume is prepared by first mixing 31.8% by volume double deionized water with 24% by volume of 70% weight concentration glycolic acid and 11% by volume of 50% weight concentration potassium hydroxide. Second, 2.8 grams per liter of the given volume of nickel sulfate hexahydrate is added to the bath. Third, distilled water is added until the given volume is reached. This is approximately 31.8% by volume. Finally, one troy ounce of gold per gallon bath is added as potassium gold cyanide which initiates a reaction as manifested by considerable gassing.

A chelating solution is prepared by mixing 500 cc of dionized water with 134 grams of nitriloacetic acid. To this, 136 grams of potassium hydroxide is added and water is added to bring the volume up to 1000 cc.

After the reaction has gone to completion, as indicated by a lessation of gassing, 100 cc of a chelating solution is added. The concentration of nickel is then analyzed and sufficient nickel as nickel sulfate hexahydrate is added to bring the concentration of nickel to about 230 ppm.

The nickel concentration is maintained at about 230 ppm by periodically determining the actual nickel concentration by analysis and adding the potassium salt of nitrilotriacetic acid in the amount indicated in the graph on the Drawing. The graph shows the relationship between nickel concentration is analyzed and the amount of chelating agent required to tie up that amount of nickel.

What is claimed is:

1. An aqueous electroplating bath for depositing a gold alloy capable of being operated at current densities of up to 600 amps per square foot and into which metal impurities are introduced comprising a salt of an alloying metal selected from the group consisting of nickel, cobalt and mixtures thereof; the reaction product of an alkali metal gold cyanide with a mixture of glycolic acid and an alkali metal salt of glycolic acid which are present in amounts sufficient to complex the alkali metal gold cyanide and in a ratio sufficient to generate a pH in the bath of from about 4 to about 5 and wherein the alloying metal is present in a predetermined ratio to the gold, said bath further comprising nitrilotriacetic acid in an amount sufficient to prevent codeposition of the introduced metal impurities with the gold alloy.

2. An electroplating bath as claimed in claim 1 in which the pH is between 4.2 and 4.35.

3. An electroplating bath as claimed in claim 1 in which the alkaline metal gold cyanide is selected from the group consisting of potassium gold cynanide, sodium gold cynanide and mixtures thereof.

4. An electroplating bath as claimed in claim 1 wherein the concentration of the alkaline metal gold cyanide provides a gold content of about 1 troy ounce per gallon of bath.

5. An electroplating bath as claimed in claim 1 in which the alkali metal salt of glycolic acid is selected from the group consisting of the sodium salt of glycolic acid, the potassium salt of glycolic acid and mixtures thereof.

6. An electroplating bath as claimed in claim 1 wherein the salt of an alloying metal is selected from the group consisting of nickel sulfate hexahydrate, cobalt sulfate hexahydrate and mixtures thereof.

7. An electroplating bath as claimed in claim 1 wherein nitrilotriacetic acid is introduced to the bath as a salt of nitrilotriacetic acid.

8. An electroplating bath as claimed in claim 7 wherein the salt of nitrilotriacetic acid is selected from the group consisting of the sodium salt of nitrilotriacetic acid, the potassium salt of nitrilotriacetic acid, the ammonium salt of nitrilotriacetic acid and mixtures thereof.

9. An electroplating bath as claimed in claim 1 wherein the metal impurity is selected from the group consisting of nickel, cobalt, copper, zinc and mixtures thereof.

10. An electroplating bath as claimed in claim 1 wherein the metal impurity is nickel.

11. An aqueous gold alloy electroplating bath into which ionic nickel from a nickel electroplating bath is dragged comprising an alloying metal salt selected from the group consisting of nickel sulfate hexahydrate, cobalt sulfate hexahydrate and mixtures thereof and the reaction product of an alkali metal gold cyanide selected of the group consisting of sodium gold cyanide, potassium gold cyanide and mixtures thereof with a mixture of a glycolic compound selected from the group consisting of glycolic acid and glycolic acid salts selected from the group of an alkali metal salt of glycolic acid and mixtures thereof said mixture being present in an amount sufficient to complex the alkali metal gold cyanide and in a ratio sufficient to provide a pH of from about 4.0 to about 5.0 and a chelating agent selected from the group consisting of nitrilotriacetic acid and salts thereof in an amount sufficient to prevent codeposition of dragged-in nickel with the gold alloy.

12. An electroplating bath as claimed in claim 11 wherein the concentration of the alkaline metal gold cyanide provides a gold content of about 1 troy ounce per gallon of bath.

13. An electroplating bath as claimed in claim 11 wherein the alloying metal salt is nickel sulfate hexahydrate.

14. An electroplating bath as claimed in claim 13 wherein the nickel sulfate hexahydrate is present in a concentration of about 2.8 grams per liter.

15. An electroplating bath as claimed in claim 11 wherein the alloying metal salt is cobalt sulfate hexahydrate.

16. An electroplating bath as claimed in claim 11 wherein the nickel sulfate hexahydrate is present in a concentration of about 2.4 grams per liter.

17. An electroplating bath as claimed in claim 11 comprising a salt of nitrilotriacetic acid selected from the group consisting of the sodium salt of nitrilotriacetic acid, the potassium salt of nitrilotriacetic acid, the ammonium salt of nitrilotriacetic acid and mixtures thereof.

18. An electroplating bath as claimed in claim 11 comprising the potassium salt of nitrilotriacetic acid.

19. In an electroplating process for the deposition of a gold alloy from an aqueous electroplating bath into which metal ion impurities are introduced and which comprises free ions of alloying metal salt selected from the group consisting of nickel sulfate hexahydrate, cobalt sulfate hexahydrate and mixtures thereof and the reaction product of an alkali metal gold cyanide selected from the group consisting of sodium gold cyanide, potassium gold cyanide and mixtures thereof with a mixture of glycolic acid and an alkali metal salt of glycolic acid selected from the group consisting of the sodium salt of glycolic acid, the potassium salt of glycolic acid and mixtures thereof wherein said glycolic acid and alkali metal salt of glycolic acid are present in concentrations sufficient to complex the alkali metal gold cyanide and in a ratio sufficient to generate a pH in the bath of from about 4 to about 5 and wherein free ions of alloying metal to gold are present in a predetermined ratio, the improvement which comprises maintaining in the aqueous electroplating bath a compound selected from the group consisting of nitrilotriacetic acid, salts of nitrilotriacetic acid and mixtures thereof in an amount sufficient to substantially maintain the free ions of the alloying metal to gold in said predetermined ratio by complexing with introduced metal ion impurities.

20. An electroplating process as claimed in claim 19 comprising the salt of nitrilotriacetic acid selected from the group consisting of the sodium salt of nitrilotriacetic acid, the potassium salt of nitrilotriacetic acid, the ammonium salt of nitrilotriacetic acid and mixtures thereof.

21. An electroplating process as claimed in claim 19 comprising the potassium salt of nitrilotriacetic acid.

22. An electroplating process as claimed in claim 21 wherein the potassium salt of nitrilotriacetic acid is maintained in a concentration of which provides about 5 parts salt of nitrilotriacetic acid for each part metal impurity that is introduced to the bath.

23. A process for electroplating an alloy of gold and nickel onto a substrate from an aqueous gold alloy electroplating bath which comprises ionic nickel in a predetermined concentration, the reaction product of an alkali metal gold cyanide and a mixture of glycolic acid and an alkali metal salt of glycolic acid, wherein the glycolic acid and the alkali metal salt of glycolic acid are present in sufficient quantity to complex the alkali metal gold cyanide and in a ratio sufficient to provide a pH of from about 4 to about 5 comprising the steps of:

a. plating the substrate with nickel in a nickel electroplating bath;
b. electroplating the nickel plated substrate with the alloy of gold and nickel in the aqueous gold alloy electroplating bath; and
c. introducing nitrilotriacetic acid to the gold alloy electroplating bath in a concentration sufficient to complex all ionic nickel introduced to said aqueous gold plating bath from said nickel plating bath to maintain free ionic nickel in said gold alloy electroplating bath at said predetermined concentration.

24. A process as claimed in claim 23 wherein the nitrilotriacetic acid is introduced to said gold electroplating bath as a salt selected from the group consisting of the sodium salt of nitrilotriacetic acid, the potassium salt of nitrilotriacetic acid and mixtures thereof.

25. A process as claimed in claim 23 wherein the nitrilotriacetic acid is introduced to said gold electroplating bath as an aqueous solution comprising approximately equal portions by weight of nitrilotriacetic acid and potassium hydroxide.

26. A process as claimed in claim 23 wherein the nitrilotriacetic acid is produced in said gold electroplating bath in a ratio of about five parts salt of nitrilotriacetic acid to one part ionic nickel impurity.

27. In a process wherein a substrate is plated with nickel in a nickel electroplating bath and then transferred to a gold alloy electroplating bath comprising a salt of an alloying metal selected from the group consisting of nickel, cobalt and mixtures thereof, the reaction product of an alkali metal gold cyanide with a mixture of glycolic acid and an alkali metal salt of glycolic acid which are present in an amount sufficient to complex the alkali metal gold cyanide and in a predetermined ratio sufficient to generate a pH in the bath of from about 4 to about 5 wherein a gold alloy is deposited onto the nickel plated substrate, the improvement comprising a process for preventing the codeposition of nickel from ionic nickel which has been dragged into the gold alloy electroplating bath from the nickel electroplating bath comprising the steps of:

a. determining the rate at which ionic nickel is dragged into the gold alloy electroplating bath; and
b. introducing nitrilotriacetic acid as a sodium or potassium salt to the gold alloy electroplating bath at a rate sufficient to maintain essentially all of the ionic nickel dragged over from the previous nickel electroplating bath in a complex with the nitrilotriacetic acid and to maintain the predetermined ratio of alloying metal to gold thereby preventing the codeposition of nickel from the dragged-in ionic nickel with the gold alloy.

28. An electroplating bath into which metallic impurities are introduced comprising an aqueous solution formed of a sulfate salt of an alloying metal selected from the group consisting of nickel, cobalt, and mixtures thereof, the reaction product of a potassium-gold cyanide salt and glycolic acid in which gold is present in an amount sufficient to provide gold in a concentration of from about 0.5 to about 5 troy ounces per gallon, and at least one alkali metal hydroxide, said aqueous solution containing glycolic acid and alkali metal hydroxide in an amount sufficient to complex the potassium-gold cyanide salt and in proportion to provide a pH of from about 4.2 to about 4.35, the gold and alloying metal present in solution being in proportion to provide on electrodeposition an electroplate of a gold alloy, wherein the electroplating bath further comprises nitrilotriacetic acid in an amount sufficient to prevent codeposition of the metallic impurities with the gold alloy.

29. A method of depositing a layer of a gold alloy on a metallic surface by electrolysis, the method comprising the steps of:

a. immersing a metallic surface on a substrate in a nickel electroplating bath;

b. plating onto the metallic surface a deposit of nickel;

c. immersing the metallic surface in a gold alloy electroplating bath comprising, in an aqueous solution, glycolic acid and a metal hydroxide proportioned to provide the solution a pH between about 4.2 and about 4.35, the potassium-gold cyanide salt being present in an amount sufficient to provide gold in a concentration of from about 0.5 to about 5 troy ounces per gallon of solution and the glycolic acid being present in an amount sufficient to complex the potassium-gold cyanide salt, and a sulfate salt of an alloying metal selected from the group consisting of nickel and cobalt, said salts being proportioned to permit electroplating of a gold layer with the alloying metal on the metallic surface;

d. introducing nitrilotriacetic acid into the gold alloy electroplating bath in an amount sufficient to prevent codeposition of nickel dragged into the gold alloy electroplating bath from the nickel electroplating bath with the gold alloy;

e. establishing, with agitation, in the gold alloy electroplating bath an electric current between an anode and the metallic surface at a current density in excess of 30 amperes per square foot of the metallic surface to be gold-plated; and f. plating onto the metallic surface a deposit of gold alloy to a select thickness.

* * * * *